US005264668A

United States Patent [19]

Rizzo

[11] Patent Number: 5,264,668

[45] Date of Patent: Nov. 23, 1993

[54] SMOKE DETECTOR MUFFLING DEVICE

[76] Inventor: Frank J. Rizzo, 2580 Lexington Ave., East Meadow Long Island, N.Y. 11554-3523

[21] Appl. No.: 993,368

[22] Filed: Dec. 18, 1992

[51] Int. Cl.[5] ..... G10K 11/00; G08B 23/00

[52] U.S. Cl. ..... 181/205; 340/628; 340/693

[58] Field of Search ..... 181/198, 200, 201, 202, 181/205, 211; 340/693, 628, 632

[56] References Cited

U.S. PATENT DOCUMENTS

| | | | |
|---|---|---|---|
| 4,529,976 | 7/1985 | Jameson et al. | 340/628 |
| 4,796,015 | 1/1989 | Admire, Jr. | 340/693 |
| 4,954,816 | 4/1990 | Mattison | 340/693 |

*Primary Examiner*—Michael L. Gellner
*Assistant Examiner*—Khanh Dang
*Attorney, Agent, or Firm*—Leon Gilden

[57] ABSTRACT

A device for temporarily muffling and screening of audible generation from an associated smoke detector is provided to include a housing of a soft resilient polymeric foam material, having a cavity to receive a smoke detector in complementary relationship thereto.

7 Claims, 4 Drawing Sheets

SMOKE DETECTOR MUFFLING DEVICE

BACKGROUND OF THE INVENTION

1. Field of the Invention

The field of invention relates to smoke detection apparatus, and more particularly pertains to a new and improved smoke detector muffling device to provide for the temporary masking of smoke directed to the smoke detector and associated noise generation from the smoke detector during various cooking and smoke generating procedures.

2. Description of the Prior Art

In various domestic endeavors such as cooking and the like, smoke is temporarily generated such as in cooking that is not associated with a harmful or dangerous situation. Frequently, however, such smoke generated effects the actuation of a smoke detector in an attendant unpleasant and unwarranted noise relative to a smoke detection signal. The instant invention provides for a masking structure to receive a smoke detector therewithin to prevent smoke from reaching the smoke detector and simultaneously preventing noise from being generated beyond the masking structure. Prior art smoke detector structure is provided in U.S. Pat. No. 4,529,976 wherein a smoke detector is provided with a masking shield to merely obscure the smoke detector housing from normal view.

U.S. Pat. No. 4,954,816 to Mattison sets forth a smoke detector having a decorative facade formed therewith.

The instant invention attempts to overcome deficiencies of the prior art by providing a smoke detector masking structure arranged for ease of use as well as effectiveness in construction in the temporary masking of a smoke detector within a foam housing and in this respect, the present invention substantially fulfills this need.

SUMMARY OF THE INVENTION

In view of the foregoing disadvantages inherent in the known types of smoke detector apparatus now present in the prior art, the present invention provides a smoke detector muffling device wherein the same provides for the temporary masking of a smoke detector relative to smoke and the like during cooking procedures and such. As such, the general purpose of the present invention, which will be described subsequently in greater detail, is to provide a new and improved smoke detector muffling device which has all the advantages of the prior art smoke detector apparatus and none of the disadvantages.

To attain this, the present invention provides a device for temporarily muffling and screening of audible generation from an associated smoke detector, to include a housing of a soft resilient polymermic foam material, having a cavity to receive a smoke detector in complementary relationship thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved smoke detector muffling device which has all the advantages of the prior art smoke detector apparatus and none of the disadvantages.

It is another object of the present invention to provide a new and improved smoke detector muffling device which may be easily and efficiently manufactured and marketed.

It is a further object of the present invention to provide a new and improved smoke detector muffling device which is of a durable and reliable construction.

An even further object of the present invention is to provide a new and improved smoke detector muffling device which is susceptible of a low cost of manufacture with regard to both materials and labor, and which accordingly is then susceptible of low prices of sale to the consuming public, thereby making such smoke detector muffling devices economically available to the buying public.

Still yet another object of the present invention is to provide a new and improved smoke detector muffling device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
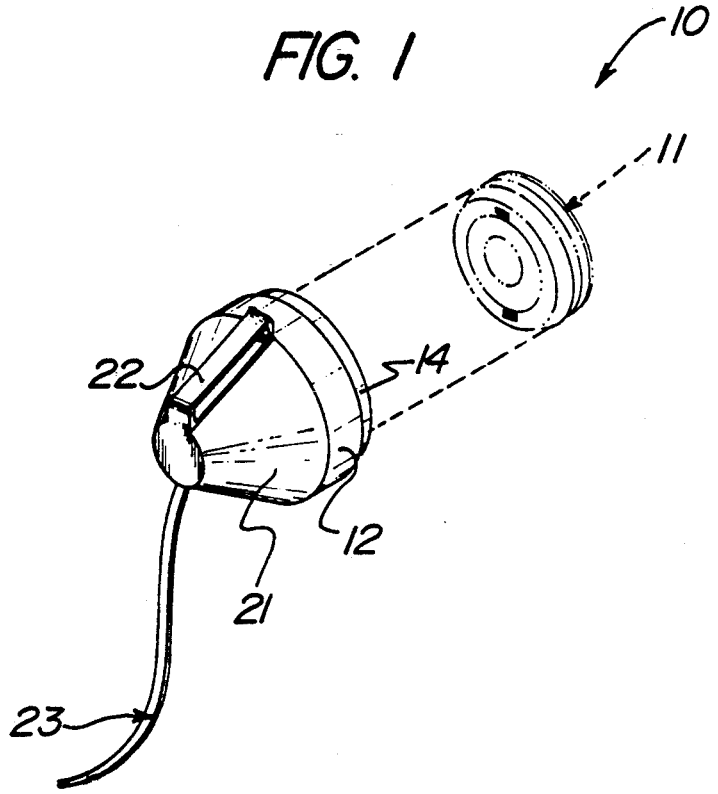
FIG. 1 is an isometric illustration of the invention.
Figure 2:
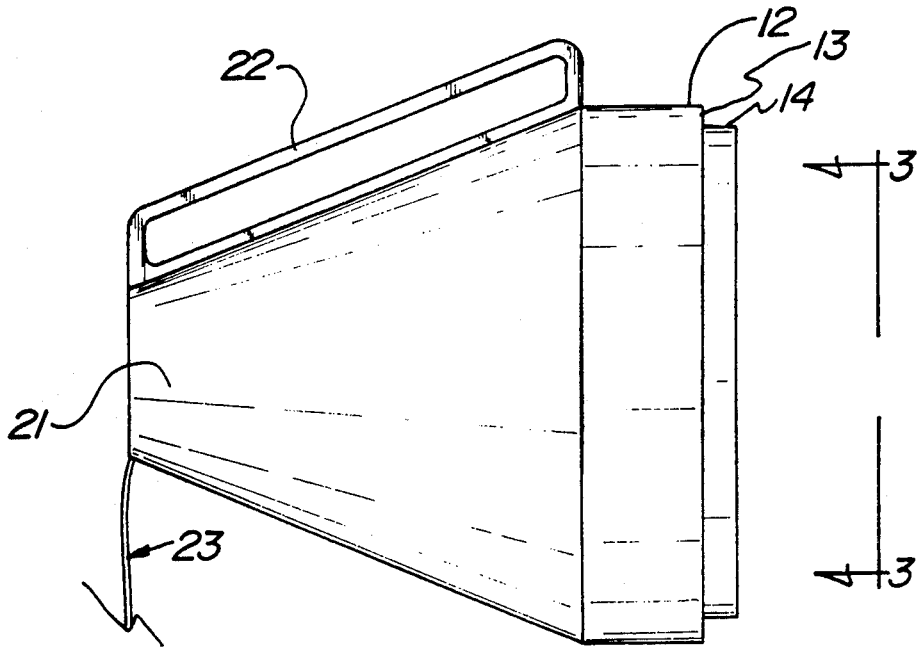
FIG. 2 is an orthographic side view of the invention.
Figure 3:
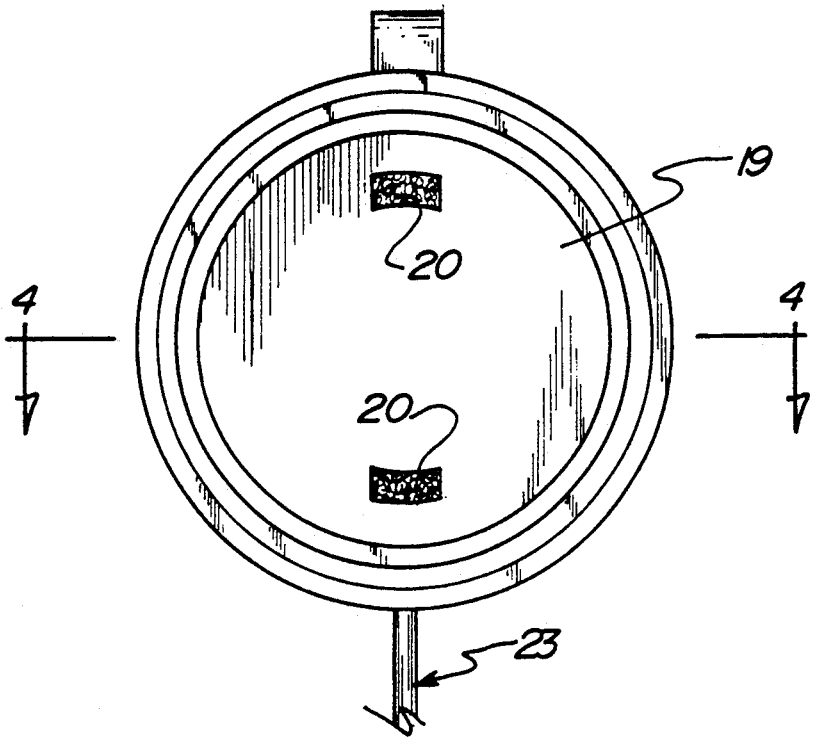
FIG. 3 is an orthographic view, taken along the lines 3—3 of FIG. 2 in the direction indicated by the arrows.
Figure 4:
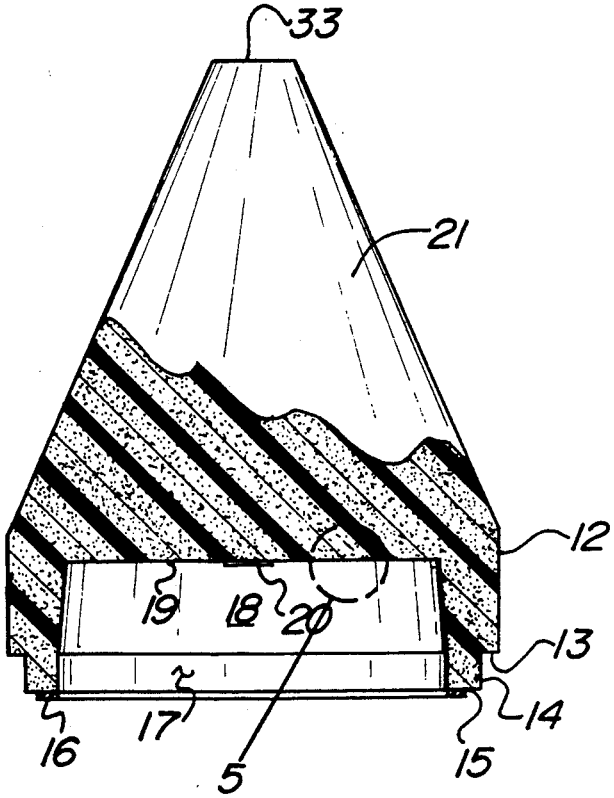
FIG. 4 is an orthographic view, taken along the lines 4—4 of FIG. 3 in the direction indicated by the arrows.
Figure 5:
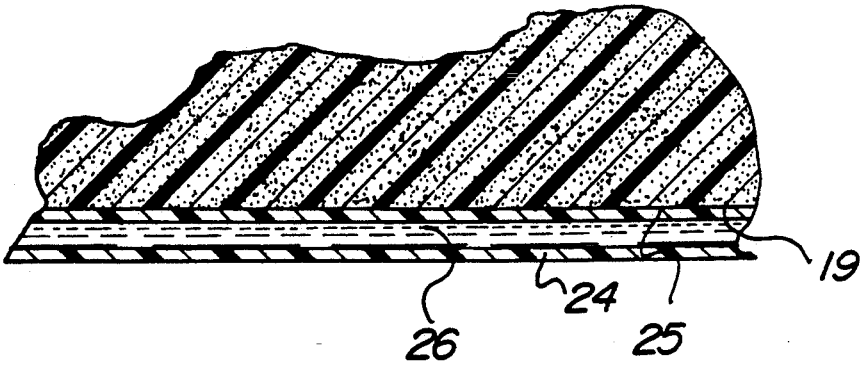
FIG. 5 is an enlarged orthographic view of section 5 as set forth in FIG. 4.
Figure 6:
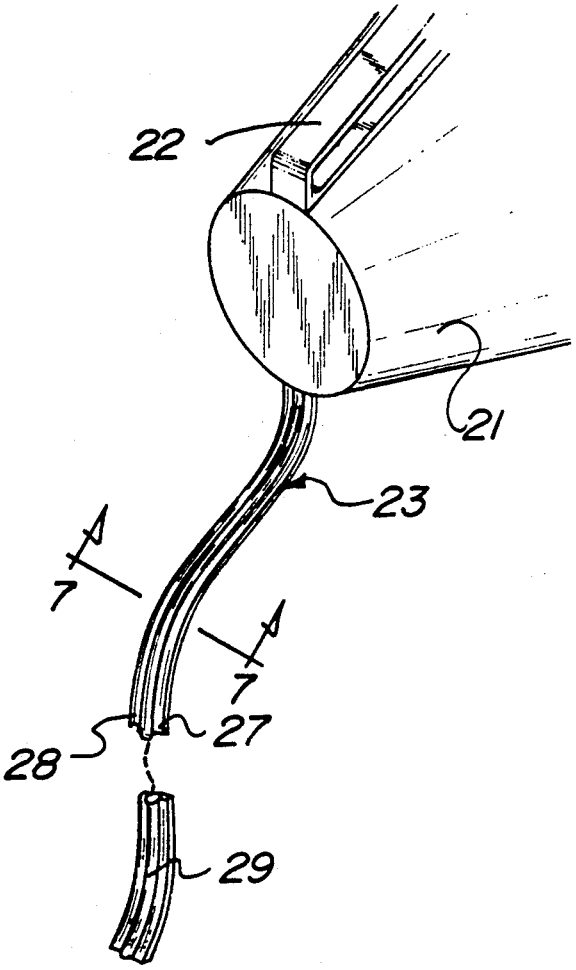
FIG. 6 is an enlarged isometric illustration of the signal strip employed by the invention.

With reference now to the drawings, and in particular to FIGS. 1 to 8 thereof, a new and improved smoke detector muffling device embodying the principles and concepts of the present invention and generally designated by the reference numeral 10 will be described.

Figure 7:
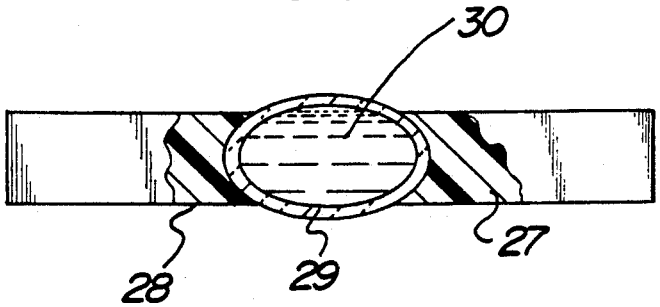
FIG. 7 is an orthographic view, taken along the lines 7—7 of FIG. 6 in the direction indicated by the arrows.

More specifically, the smoke detector muffling device 10 of the instant invention essentially comprises a polymeric foam housing arranged for complementarily receiving a smoke detector member 11 therewithin. The housing includes a housing cylindrical wall 12 having a cylindrical wall end wall 13, with a cylindrical projecting skirt 14 fixedly mounted to the cylindrical end wall 13, with the skirt 14 having a skirt diameter and the cylindrical wall having a cylindrical wall diameter greater than the skirt diameter providing for a skirt of greater flexibility in the encompassing of the smoke detector member 11 within the housing. The skirt 14 is formed with a skirt end wall 15 to include an annular adhesive strip 16 thereon to provide for the adherence of the housing to a wall surface mounting the smoke detector member 11. The housing is formed with a cylindrical cavity 17 defined as a first cavity within the skirt 14 and a second cavity 18 typically of a truncated conical cavity configuration within the cylindrical wall 12 to insure frictional engagement of the peripheral side wall of the smoke detector member 11. It should be noted that the cylindrical wall 12, as well as the skirt 14, are coaxially aligned relative to one another as are the first and second cavities 17 and 18 respectively. The second cavity 18 is formed with a second cavity floor 19 having at least one and typically a plurality of adhesive members 20 mounted to the floor for adherence to a face portion of the smoke detector member 11. The housing is further formed with a conical body extension 21 projecting from the cylindrical wall 12 coaxially aligned relative to the cylindrical wall, as the truncated conical body extension 21 is formed with a housing end wall 33. The truncated conical portion 21 provides for enhanced ease of manipulation of the organization as a handle 22 is mounted coextensively along the truncated conical body extension 21. In this manner, the polymeric foam mass of the body extension 21 provides for sound absorption as well as ease of manual manipulation of the organization in its mounting upon the smoke detector member 11. A signal strip 23 projects from adjacency to the housing end wall 33 to provide for signalling of the masking structure relative to the housing. The signal strip 23 is indicated in FIG. 7 and includes opaque first and second ribbon strips 27 and 28 of flexible construction, having a transparent flexible housing 29 intermediate and coextensive with the first and second ribbon strips 27 and 28. The transparent flexible housing 29 includes a chemiluminescent fluid 30 therewithin. The signal strip in this manner is arranged to provide for enhanced visual notation that the housing is mounted to the associated smoke detector member 11 and that subsequent to the temporary mounting of the housing onto the smoke detector, it is intended for removal. The member provides for the avoidance of various types of smoke such as in a cooking scenario from reaching the smoke detector member, as well as audible noise generation from the smoke detector member. Priorly, the mere removal of batteries from the smoke detector has been attempted but frequently batteries are not replaced having a resultant dangerous condition in a non-armed smoke detector structure.

Figure 8:
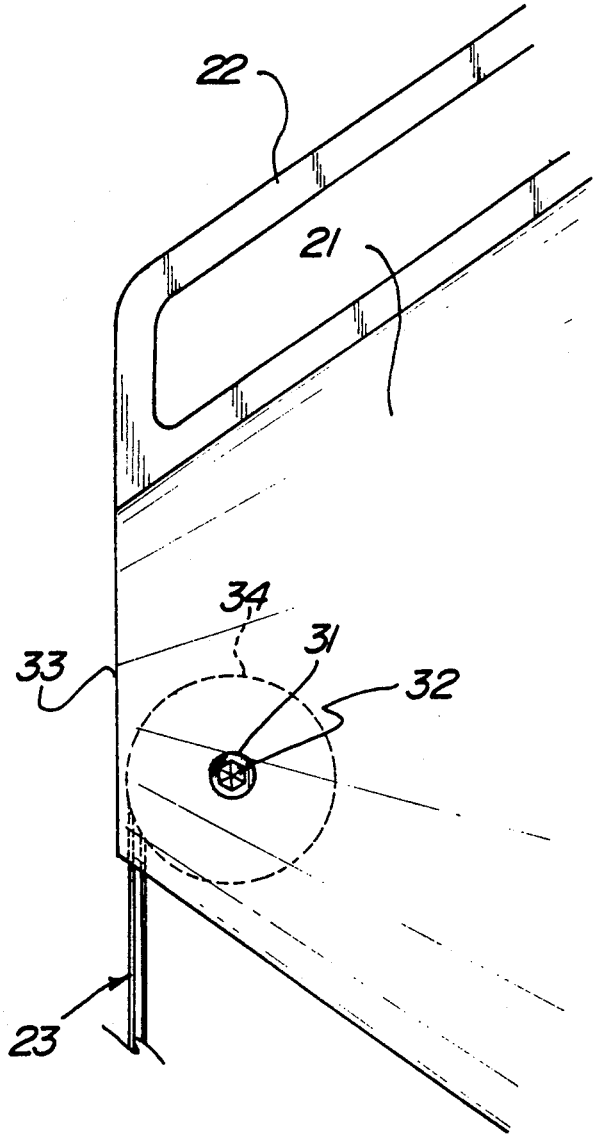
FIG. 8 is an orthographic side view of the signal strip arranged for reeling within the smoke detector masking housing.

The FIG. 8 indicates the use of a support axle 31 directed through the housing in adjacency to the housing end wall 33 mounting a reel 34. The support axle 31 includes a projecting shaft 32 permitting rotation of the support axle and associated reel 34 fixedly mounted to the support axle 31 to provide for the reeling and winding of the signal strip 23 about the reel 34 subsequent to utilization of the organization 10 for its transport and storage minimizing damage to the signal strip 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A smoke detector muffling device for receiving a smoke detector member therewithin, wherein the smoke detector member includes a cylindrical housing having a front wall, wherein the device comprises, a housing cylindrical wall having a cylindrical wall end wall, with the cylindrical wall end wall having a cylindrical projecting skirt directed therefrom, wherein the cylindrical wall and the cylindrical projecting skirt are coaxially aligned relative to one another, and the cylindrical projecting skirt includes a cylindrical projecting skirt end wall, and the cylindrical projecting skirt end wall includes an annular adhesive strip coextensively secured to the cylindrical projecting skirt end wall for adherence in surrounding relationship relative to said smoke detector.

2. A smoke detector muffling device as set forth in claim 1 wherein the housing cylindrical wall includes a conical body extension coaxially aligned with the cylindrical wall, wherein the cylindrical wall, the cylindrical projecting skirt, and the conical body extension are formed as a polymeric foam housing, and the housing including a first cavity positioned within the cylindrical projecting skirt, and a second cavity positioned between the cylindrical projecting skirt and the conical body extension.

3. A smoke detector muffling device as set forth in claim 2 wherein the second cavity includes a second cavity floor and a plurality of adhesive members mounted to the second cavity floor for adherence to the smoke detector front wall.

4. A smoke detector muffling device as set forth in claim 3 wherein the conical body extension includes a housing end wall spaced from the second cavity floor, and a handle extends coextensively along the conical body extension, and a signal strip is mounted to the conical body extension in adjacency to the housing end wall.

5. A smoke detector muffling device as set forth in claim 4 wherein the second cavity floor includes a fluid impermeable membrane mounted coextensively therewith, and a further fluid impermeable membrane is spaced relative to the fluid impermeable membrane, and a viscous fluid is positioned between the fluid impermeable membrane and a further fluid impermeable membrane for muting of audible generation relative to the smoke detector.

6. A smoke detector muffling device as set forth in claim 5 wherein the signal strip includes spaced first and second ribbon strips arranged in a coextensive relationship relative to one another, and a transparent flexible housing arranged coextensively and medially of the first and second ribbon strips, with a chemiluminescent fluid positioned within the transparent flexible housing.

7. A smoke detector muffling device as set forth in claim 6 including a support axle directed into the conical body extension in adjacency to the housing end wall, and a reel member fixedly mounted about the support axle within the conical body extension, and the support axle includes a projecting shaft projecting exteriorly of the conical body extension, with the reel mounted for rotation within the conical body extension about the support axle, and the signal strip is mounted to the reel to permit selective reeling of the signal strip about the reel for storage and transport of the housing.

* * * * *